United States Patent [19]

Miura et al.

[11] Patent Number: 4,626,410

[45] **Date of Patent: * Dec. 2, 1986**

[54] METHOD OF MAKING COMPOSITE MATERIAL OF MATRIX METAL AND FINE METALLIC PARTICLES DISPERSED THEREIN

[75] Inventors: Hirohisa Miura; Hiroshi Satou; Toshio Natsume; Hidenori Katagiri; Yoshiro Hayashi; Masahiro Taguchi, all of Aichi, Japan

[73] Assignee: Toyota Jidosha Kabushiki Kaisha, Toyota, Japan

[ * ] Notice: The portion of the term of this patent subsequent to Nov. 27, 2001 has been disclaimed.

[21] Appl. No.: 620,176

[22] Filed: Jun. 13, 1984

[30] Foreign Application Priority Data

Jul. 13, 1983 [JP] Japan ..... 58-127439

[51] Int. Cl.[4] ..... B22F 9/00; C22C 23/00

[52] U.S. Cl. ..... 420/590; 75/0.5 B

[58] Field of Search ..... 420/590; 75/129, 0.5 R, 75/0.5 B, 0.5 BA, 0.5 BB

[56] References Cited

U.S. PATENT DOCUMENTS 4,484,943 11/1984 Miura et al. ..... 75/0.5 B
4,508,682 4/1985 Miura et al. ..... 420/590

FOREIGN PATENT DOCUMENTS 802133 12/1968 Canada ..... 420/590

*Primary Examiner*—Christopher W. Brody
*Attorney, Agent, or Firm*—Oblon, Fisher, Spivak, McClelland & Maier

[57] ABSTRACT

A composite material having a first metallic material as the matrix material and extremely fine particles of diameters of the order of tens to hundreds of angstroms of a second metal dispersed in this metallic matrix material is obtained by rapidly adiabatically cooling vapor of the second metallic material through a nozzle, and squirting a jet of fine particles produced thereby into a molten mass of the first material. Optionally, inert gas may be squirted through the nozzle along with the vapor of the second metallic material.

5 Claims, 5 Drawing Figures

500Å

METHOD OF MAKING COMPOSITE MATERIAL OF MATRIX METAL AND FINE METALLIC PARTICLES DISPERSED THEREIN

BACKGROUND OF THE INVENTION

The present invention relates to a two phase or composite material using a first metallic material as a matrix material and with fine particles made of a second metal dispersed therein as reinforcing material, and to a method of making such a composite material.

It has been recognized in the past that it is possible to supplement various deficiencies of a first type of metallic material without deteriorating its good characteristics by dispersing particles of a second harder type of metal or of a ceramic compound (which is typically very hard) within the first metallic material. Therefore, in the prior art, in the case of light metals such as aluminum alloy, magnesium alloy, and titanium alloy, it has been attempted to increase their strength and their heat resistance by dispersing in them ceramic particles such as silicon carbide and silicon nitride and also particles of hard metals; and in the case of copper alloys such as those for making electrode tips for spot welding and for making bearings it has been attempted to increase their wear resistance by dispersing in them ceramic particles and hard metal particles to such an extent as will not substantially deteriorate their electrical conductivity and their performance as bearing materials. In the case of such a composite material including a metallic material as a matrix material and dispersed particles of metal or ceramic compound as reinforcing material, in order to effectively supplement the deficiencies of the metallic matrix material without deteriorating its useful properties the particles to be mixed must be minute and must be uniformly dispersed in said metallic material; and further, in order to make the resulting particle dispersion composite material economically, the mixed in particles must be economically available.

However, in the prior art such metal-metal particle dispersion composite materials have been made by utilizing reinforcing particles with diameters in the range of from one micron to tens of microns, which have been formed by mechanical breaking methods or atomization methods. Also, the method typically used for dispersing these metal reinforcing particles in the molten matrix metal has been either simply to mix them mechanically, or alternatively to utilize the so called jet dispersal method in which a jet of inert gas such as argon gas carrying the metallic reinforcing particles mixed with is introduced into the molten matrix metal. However, metallic particles with an average diameter of less than one micron cannot be economically produced by such mechanical breaking methods or atomization methods, and, since the metallic particles made as described above have small surface activity and have relatively poor wettability with respect to the molten metallic matrix material, the problem arises that unevenness in the distribution in the vertical direction of the metallic particles inevitably tends to occur between higher and lower strata of the molten composite material, due to the difference in specific gravities between the metallic particles and the matrix metal. In other words, it is very difficult or impossible to evenly distribute such fine metallic reinforcing particles in the molten matrix metal by mechanical mixing or by the jet dispersal method.

SUMMARY OF THE INVENTION

In view of the above described problems with regard to composite materials including metal as matrix material and fine dispersed metal particles as reinforcing material, the present Inventors have been impelled to perform various experimental researches which will be detailed later in this specification. As a result of these experiments, the inventors have determined that it is possible to manufacture extremely fine reinforcing particles of a metal, with diameters of several hundred angstroms or less and with very strong surface activity, by expelling metallic vapor through an expansion nozzle, so as to provide adiabatic expansion and very rapid cooling; and futher the Inventors have determined that it is a very effective method of evenly and finely dispersing these very fine metal particles in a matrix of metallic material to direct the jet flow from said nozzle against the surface of a mass of the molten metal matrix material.

Accordingly, it is the primary object of the present invention to provide a method for manufacture for a composite material including metal reinforcing particles in a metallic matrix, in which the particles are much finer than in the prior art.

It is a further object of the present invention to provide a method of manufacture for such a composite material, in which the reinforcing particles of said metal are very evenly dispersed in the metallic matrix.

It is a further object of the present invention to provide a method of manufacture for such a composite material, in which the intimacy of the contact between the metal particles and the metallic matrix material is excellent.

It is a further object of the present invention to provide a method of manufacture for such a composite material, in which the dispersion of the reinforcing metal particles is excellent, even when the specific gravities of the metal particles and of the metallic matrix material are very different.

It is a further object of the present invention to provide a method of manufacture for such a composite material, whose properties are suitably uniform.

It is a yet further object of the present invention to provide a method of manufacture for such a composite material, which is efficient and economical.

It is a yet further object of the present invention to provide a method of manufacture for such a composite material, which can well control the metal reinforcing particle size.

It is a yet further object of the present invention to provide a method of manufacture for such a composite material, which can conveniently be performed as a continous process instead of a batch mode.

It is a concomitant object of the present invention to provide a composite material having improved characteristics.

According to the most general aspect of the present invention, these and other objects relating to a method are accomplished by a method of making a composite material comprising a first metallic material as matrix material and fine particles of a second metal dispersed therein, wherein vapor of said second metal is rapidly cooled by being adiabatically expanded through a nozzle, and a jet flow from said nozzle is directed into a mass of said first metallic material in molten state.

According to such a method, by the rapid cooling of said jet flow by adiabatic expansion in the nozzle, the flow impinging on the surface of the molten first metal matrix material contains extremely fine particles of the second metal with diameters in the range of a few hundreds of angstroms, which have just solidified and accordingly have extremely high surface activity. These very active and very fine particles are entrained into the molten first metal matrix material by impinging on the surface thereof at high speed, and become thoroughly and evenly mixed therein. Good mixing of the particles of the second metal with the molten first metal matrix material is effected by the fact that the high speed jet impinging on the surface of the molten mixture has a strong effect to churn it up and to render it uniformly mixed. Because of the high surface activity and the fineness of the metal particles, difference between the specific gravity of the material of the particles and the specific gravity of the molten first metal matrix material do not cause any substantial effect of layering of the resulting composite material. Because the fine particles of the second metal are manufactured in a continuous fashion and are continuously mixed into the molten first metal mass, there arises no problem of these fine particles sticking to one another, such as would be inevitable if the fine particles of the second metal were first manufactured, and later attempts were made to stir a mass of the fine particles into the molten first metal mass.

Various suitable materials which have been realized for the reinforcing particles are molybdenum and cobalt; and a suitable material which has been realized for the matrix material is copper alloy.

In the method of this invention, part of the thermal energy in the metallic vapor is converted into kinetic energy by the adiabatic expansion in the nozzle, and the jet flow out from the nozzle can attain a high speed of from Mach 1 to 4. If the pressure and the temperature of the gas (or gaseous mixture) upstream of the nozzle are $P_1$ (in torr) and $T_1$ (in degrees K.) respectively, and the pressure and the temperature of the gas or gaseous mixture downstream of the nozzle are $P_2$ (in torr) and $T_2$ (in degrees K.) respectively, and the speed of the jet flow out of the nozzle is $M_2$ (in Mach number), then:

$$T_2 = T_1 \times (P_2/P_1)^{((k-1)/k)}$$

$$M_2 = SQRT(2/(K-1))((P_2/P_1)^{((1-k)/k)} - 1))$$

(k is the specific heat ratio of the gas body)

In the case that a convergent nozzle is used for the cooling nozzle, then the speed $M_2$ reaches Mach 1 when the nozzle outlet pressure $P_2$ reaches a critical pressure $(P_1 \times (2/(k+1))^{(2/(k-1))})$ and the speed $M_2$ does not increase beyond that, no matter how far below the pressure $P_2$ drops. On the other hand, in the case that a convergent-divergent nozzle (a so-called Laval nozzle) is used for the cooling nozzle, then the speed $M_2$ rapidly increases as $P_2/P_1$ decreases, and reaches Mach 4 when $P_2/P_1 = 1/100$. The temperature $T_1$ may be selected according to the vapor pressure of the metallic particles which are to be dispersed in the metallic matrix material. Assuming that $T_1 = 2{,}273$ degrees K. (2,000 degrees C.) and the specific heat ratio $k = 1.667$, then, according as to the pressure ratio $(P_2/P_1)$ reduces from 1/5 to 1/100, the temperature $T_2$ and the speed $M_2$ of said jet flow downstream of the cooling nozzle change as shown in Table 1, which is located at the end of this specification and before the appended claims. From this Table 1, for example, it can be seen that when the pressure ratio $P_1/P_2$ is equal to 1/10, then $T_2$ is equal to 905° K. (632° C.) and $M_2$ is equal to 2.13 (approximately 1400 meters/sec).

Thus, since as shown above the speed of the metallic particles as they impinge against the surface of the molten metal matrix material is sonic or higher, thereby they are infused into the molten matrix material before they have the time to lose their very high surface activity which is due to their newly formed character, as explained above; and also due to this high speed of the jet flow from the nozzle the stirring of the mixture is performed very effectively. However, in order to further encourage the uniform mixing of the fine metallic particles into the molten metal matrix material, a mechanical stirring means may be also used, as is explained later in this specification. Since part of the kinetic energy of the fine metal particles is converted into thermal energy as the particles impinge into the molten metal matrix material, it is considered to be advantageous to arrange the operational parameters of the process so that the temperature $T_2$ of the jet flow downstream of the nozzle is slightly less than the temperature of the molten metal matrix material, in order to maintain said molten matrix material temperature at a substantially constant level without applying too much heating.

According to a specialization of this invention, an inert gas such as argon gas for acting as a carrier gas is added to the vapor of the second metal before passing it through the nozzle. In such a case, this carrier gas has a useful effect of inducting the metallic vapor more quickly and continuously into the nozzle, and thus the metallic vapor is prevented from growing into large particles by amalgamation. Thereby, the size of the fine metallic particles may be reduced, and variations or fluctuations in their density may be likewise reduced. Further, in this case, by controlling the flow rate of the inert gas, the pressure ratio $P_1/P_2$ of the mixture gas flow before and after the nozzle may be advantageously easily controlled, and so the cooling speed of the mixture gas and the particle size may be controlled.

The nozzle used may be either a convergent or a convergent-divergent nozzle; but a convergent-divergent nozzle is preferred to be used, in order to increase the speed of the jet flow therefrom, and thus to promote the smallness in size and evenness in size of the fine metallic particles, as well as increasing the stirring effect of the jet flow on the molten mixture.

This method of making a composite material may be readily adapted to continuous rather than batchwise operation, by causing the molten first metal matrix material to flow at a fixed flow rate relative to the nozzle.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

The present invention will now be described with reference to the preferred embodiments thereof, and with reference to the appended drawings. First, however, an apparatus related thereto will be described.

Figure 1:
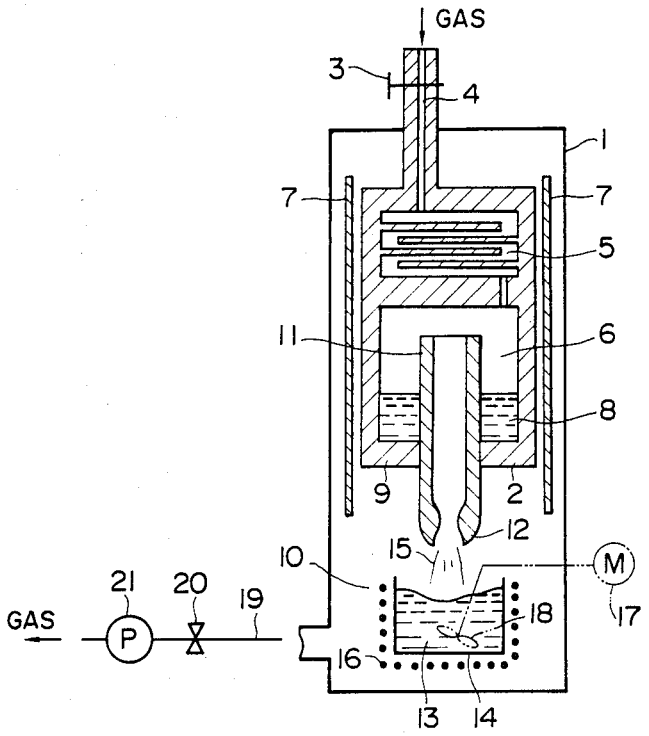
FIG. 1 is a schematic structural sectional view showing a metal reinforcing particle-metal matrix type reinforced material production device which is used for performing certain preferred embodiments of the method of the present invention so as to make certain of the preferred embodiments of the material of the present invention.

Referring to FIG. 1 which shows a metal reinforcing particle-metal matrix type reinforced material production device which is used for practicing various preferred embodiments of the method of the present invention, the reference numeral 1 denotes a furnace shell, which is formed as a substantially enclosed container; and a melting pot 2 is disposed within this furnace shell 1. This melting pot 2 comprises a gas preheating chamber 5, to which gas can be fed from the outside as will be described later via a gas introduction port 4 which is controlled by a valve 3, and further comprises a metal vapor production chamber 6 communicated with said gas preheating chamber 5. Around the melting pot 2 there is disposed a heater 7 for keeping the interiors of the gas preheating chamber 5 and of the metal vapor production chamber 6 heated up to an appropriately high temperature $T_1$; and thus metal charged into the metal vapor production chamber 6 is melted into a molten metal mass 8 and is further vaporized into metallic vapor, to fill the chamber 6 and to mix with the gas (if any) introduced through the port 4.

Through the bottom 9 of the melting pot 2 there is passed a conduit 11 for connecting the metal vapor production chamber 6 with a composite material production zone 10 within the furnace shell 1 below the melting pot 2, and at the lower end of this conduit 11 there is provided a convergent-divergent nozzle 12. Thus, during use of the apparatus, a jet flow 15 of metal vapor, possibly mixed with introduced gas, and cooled to a temperature $T_2$, is squirted out from the nozzle 12. Below the convergent-divergent nozzle 12, to receive this jet flow 15, there is provided, in the composite material production zone 10, a container 14 for containing a mass 13 of molten metal matrix material (which is typically of course a different kind of metal from the kind of the metal mass 8); and this container 14 and its contents are arranged to be kept at an appropriate high temperature by a heater 16. Thus, during use of the apparatus, the surface of this molten matrix metal mass 13 is impinged upon by the jet flow 15 of metal vapor. The molten mass 13 may be stirred up by a propeller 18 which is driven by a motor 17; in fact, this is not done in the case of all the preferred embodiments, and so these elements are shown by double dotted lines to indicate that they are optional. A vacuum pump 21 is connected to the composite material production zone 10 via a valve 20 and a conduit 19, so as to keep the zone 10 and the metal vapor production chamber 6 evacuated to desired pressures, which will hereinafter be designated as $P_2$ and $P_1$ respectively.

Embodiment One

A composite material including a first metal as the matrix material and dispersed particles of a second metal as reinforcing material, in which the reinforcing metal particles were molybdenum particles and the matrix metal material was copper alloy (of composition 15% Sn, 10% Pb, and remainder Cu), was manufactured using the apparatus described above, as follows.

First, a mass of approximately 100 gm of metallic molybdenum was charged into the metal vapor production chamber 6 of the melting pot 2, and then a flow of argon gas was provided to the gas introduction port 4 and flowed into the metal vapor production chamber 6 by way of the gas preheating chamber 5, under the control of the valve 3. Meanwhile the metallic molybdenum mass was rapidly melted into a mass of molten molybdenum 8 by operation of the heater 7, till the temperature $T_1$ in the metal vapor production chamber 6 reached approximately 2900° C., so that this molybdenum was boiled.

Then, the mixture gas in the metal vapor production chamber 6 passed into the conduit 11 and downwards therein, to be squirted out of the convergent-divergent nozzle 12 into the composite material production zone 10. At this time, the valve 3, the vacuum pump 21 and the valve 20 were so regulated as to keep the pressure $P_1$ in the metal vapor production chamber 6 at approximately 2 torr, and the pressure $P_2$ in the zone 10 at approximately 0.1 to 0.2 torr. According to this, the mixture gas of molybdenum vapor and argon which had passed through the convergent-divergent nozzle 12 and had been cooled by rapid adiabatic expansion cooling therein was cooled to a temperature $T_2$ of approximately 830° C. or less, and was thus turned into a jet of extremely minute particles of solidified molybdenum carried along on a jet of argon gas. This jet impinged on the surface of a pool 13 of molten copper alloy of the above specified composition which was held in the container 14 and was maintained at a temperature of $T_3$ equal to approximately 1000° to 1050° C. by means of the heater 16. Thus, the fine particles of solidified molybdenum were largely entrained into the molten copper alloy, while the argon gas was continually carried away by the vacuum pump 21. In this first preferred embodiment, no motor 17 or propeller 18 were used for stirring the molten copper alloy up at this time.

Figure 2:
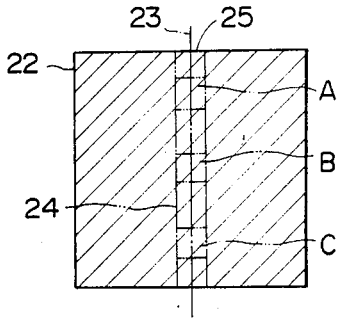
FIG. 2 is an illustrative vertical sectional view showing a solidified ingot body of metal reinforcing particle-metal matrix type reinforced material which is a preferred embodiment of the product according to the present invention, produced according to certain of the preferred embodiments of the method of the present invention.

After this process was performed for an appropriate time, the heaters 7 and 16 were turned off, and, after the resulting mass of copper alloy mixed with molybdenum particles had completely solidified in the container 14, the container 14 was taken out from the furnace shell 1, and the mass of composite material was removed from the container 14: this composite material mass was generally formed as an ingot 22 (see FIG. 2) which had a diameter of approximately 80 mm and a height of approximately 80 mm. Then, as indicated in FIG. 2, a cylindrical body 24 was cut out from this ingot 22 along its center line 23, and three cylindrical samples A, B, and C, each approximately 10 mm in diameter and 10 mm high, were cut from this cylindrical body 24 at approximate depths from its upper surface 25 of 15 mm, 40 mm, and 65 mm respectively.

Figure 5:
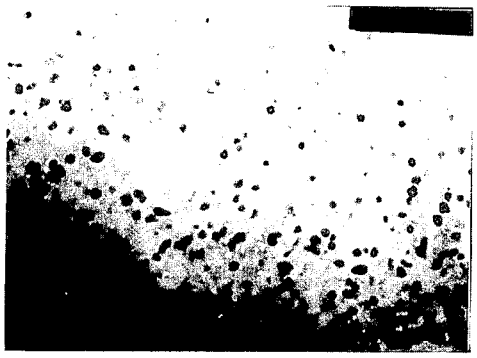
FIG. 5 is a transmission electron microscope photograph of a metal reinforcing particle-metal matrix type reinforced material using molybdenum particles as the reinforcing material and copper alloy as the matrix material, which is a particular preferred embodiment of the material according to the present invention.

For each of these samples A, B, and C the weight percentage of molybdenum particles, the range of particle diameters, and the average particle diameters were measured. The results are shown in Table 2, in its Column I. In FIG. 5, a transmission type electron microscope photograph of a portion of sample A of this first embodiment is shown: the dots are the molybdenum particles, and the other portion is the copper alloy.

It is thus clear that according to this first embodiment of the method of the present invention the molybdenum particles were produced to be of extremely small size to be from 80 to 230 angstroms, and that these particles were mixed in with the copper alloy in substantially uniform fashion through the entire extent of the copper alloy, with regard to its vertical dimension, as evidenced by the comparison of the weight percentage of molybdenum particles between the three sample pieces A, B, and C.

Modification One

Another type of composite material was manufactured as a modification of the first embodiment, using the apparatus described above, from the same combination of two materials, in the same way as the first preferred embodiment described above, except that a motor 17 and a propeller 18 as shown in FIG. 1 by the double dotted lines were used for stirring the molten copper alloy up during the infusion of the molybdenum particles thereinto from the jet flow 15.

Again, three cubic samples A, B, and C just as before were cut from the composite material column, and the weight percentage of molybdenum particles, the range of particle diameters, and the average particle diameter were measured. The results are shown in Table 2, in the column II. Comparison of columns I and II will show that the stirring was moderately helpful for yet further promoting the mixing of the reinforcing molybdenum particles in a substantially uniform fashion through the entire extent of the copper alloy.

Modification Two

Figure 3:
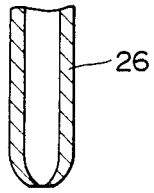
FIG. 3 is a partial longitudinal sectional view showing a convergent type nozzle, which can be used as an alternative type of cooling nozzle in the device shown in FIG. 1 for performing certain of the preferred embodiments of the method of the present invention.

Still another type of composite material was manufactured as another modification of the first embodiment, using the apparatus described above, from the same combination of two materials, in the same way as the first preferred embodiment described above, except that a convergent nozzle 26 as shown in section in FIG. 3 was used for passing the jet flow 15 through to squirt it into the composite material production zone 10, instead of the convergent-divergent nozzle 12 of the first preferred embodiment. Again, three cubic samples were cut from the composite material column located as before, and for each of these samples A, B, and C the weight percentage of molybdenum particles, the range of particle diameters, and the average particle diameter, were measured. The results are shown in Table 2, in its column III. The average particle diameter was now approximately 310 angstroms. Further, as apparent from Table 2, the distribution of the particles in the matrix as less uniform than in the first embodiment. However, this embodiment of the present invention which employs a convergent nozzle as a cooling nozzle was considered to be still effective for promoting mixing of molybdenum as minute particles in a substantially uniform fashion through the entire extent of the copper alloy, when compared with the conventional methods.

Modification Three

Still another type of composite material was manufactured as another modification of the first embodiment, using the apparatus described above, from the same combination of two materials, in the same way as the first preferred embodiment described above, except that no argon gas was mixed into the molybdenum vapor in the metal vapor production chamber 6, but instead the jet flow 15 was pure molybdenum vapor. Again, three cubic samples were cut from the composite material column located as before, and for each of these samples A, B, and C the weight percentage of molybdenum particles, the range of particle diameters, and the average particle diameters were measured. The results are shown in Table 2, in its column IV. Comparison of the data in columns I and IV will show us the benefical value of the effect of the argon gas used as a carrier for the molybdenum vapor. However, still again, this fourth embodiment of the present inventin was still considered to be effective for promoting mixing of molybdenum particles in a substantially uniform fashion through the entire extent of the copper alloy, when compared with the conventional methods.

Comparison Example

Figure 4:
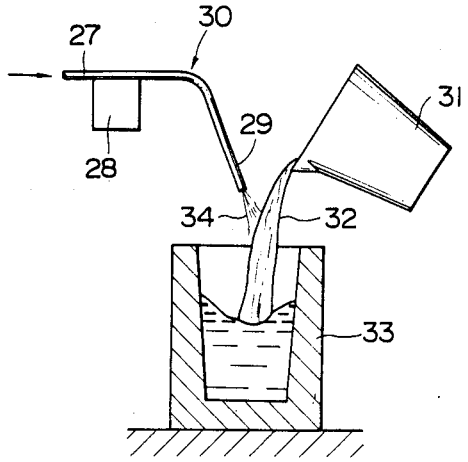
FIG. 4, which relates to the prior art, shows the process of making a comparison sample of metal reinforcing particle-metal matrix type reinforced material according to a mechanical mixing method.

For comparison, a comparison sample of composite material was made by dispersing in molten copper alloy, according to a mechanical mixing method, molybdenum particles (made by Nippon Kinzoku K.K.) of purity 99.8% which were prepared by pulverization. In this case, as shown in FIG. 4, the molybdenum particles were placed into a particle supplier 28 of an injection device 30 and were picked up by a stream of argon gas (from a source not shown in the drawing) which was passed through a conduit 27, so as to be entrained into the argon gas stream and to be injected from the injection device 30 into a stream 32 of molten copper alloy which was being poured fom a container 31 into a melting pot 33. A piece of composite material 80 mm in diameter and 80 mm in height was produced in this way, and analogous samples A, B, and C were cut therefrom to the samples of the four variations of the first embodiment of the present invention described above. The weight percentage of molybdenum particles, the range of particle diameters, and the average particle diameters were measured; the results are shown in Table 2, in its column entitled "Comparison Sample ". It can be seen that the distribution of the molybdenum particles was much more uneven than in the case of the various described embodiments of the present invention, and also the particles were very much larger in size, as well as being quite heterogenous in their diameters.

Second Embodiment

Another type of composite material including a first metal as the matrix material and dispersed particles of a second metal as reinforcing material, in which the reinforcing metal particles were cobalt particles and the matrix metal material was again copper alloy (of composition 15% Sn, 10% Pb, and remainder Cu), was manufactured using the apparatus described above, in a similar manner to the first preferred embodiment described above. The production conditions in this second preferred embodiment were as follows: the material charged in the melting pot 2 was approximately 100 gm of cobalt; the introduced gas through the gas introduction port 4 was argon gas; the temperature $T_1$ was approximately 1900° C.; pressure $P_1$ was approximately 3 torr; temperature $T_2$ was approximately 800° C. or less; pressure $P_2$ was approximately 0.5 to 0.6 torr; and temperature $T_3$ was approximately 1000° C. to 1050° C.

Again, three cubic samples were cut from the resulting composite material ingot located as before, and for each of these samples A, B, and C the weight percentage of cobalt particles, the range of particle diameters, and the average particle diameters were measured. The results are shown in Table 3, in its column I. The average particle diameter was now approximately 200 angstroms. This shows that, also in this case of using cobalt as the material for the reinforcing particles, the method according to the present invention was effective for promoting mixing of the cobalt as minute particles in a substantially uniform fashion through the entire extent of the copper alloy.

In Table 3, the data in its columns II, III, and IV shows the results of modifications with regard to the second embodiment of the same kinds as those modifications made with regard to the first embodiment; and the column entitled "Comparison Sample" shows the weight percentage of cobalt particles, the range of particle diameters, and the average particle diameters relating to a comparison sample, made in the same way as the comparison sample with regard to the first embodiment but using cobalt particles made by Outokump Co. as the reinforcing material. From these data, it will be appreciated that the same kinds of modifications to the method of the second embodiment produced the same kinds of differences with regard to the distribution of particles in the matrix metal body, the range of particle diameters, and the average particle diameters in the composite materials obtained, as in the first embodiment.

From these various embodiments described above, it can be seen that according to the method of the present invention it is possible to disperse extremely fine metallic particles into metallic material in a uniform manner in matrix metal. Indeed, if it had been attempted to mix such extremely fine metallic particles by any of the prior art methods into molten metallic material, they would have inevitably coagulated together into lumps and been incapable of mixing properly therewith. It is also seen from some of the above modifications with regard to the above embodiments that stirring of the molten metal matrix material during the dispersion process for the fine metallic particles thereinto is effective for further promoting the evenness and uniformity of dispersal of the fine metallic particles. Further, in the case that a convergent nozzle is used for the nozzle for providing adiabatic expansion cooling for the metal vapor from the melting pot 2 (possibly mixed with an inert gas), it is seen from some of the above modifications that the particles of metallic reinforcing material become far larger than otherwise, but still these particles are much smaller than any that have been utilized in the conventional methods, and the good advantages of the present invention are still available.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

TABLE 1

| $P_1/P_2$ | 1/5 | 1/10 | 1/20 | 1/50 | 1/100 |
|---|---|---|---|---|---|
| $T_2$(°K) | 1194 | 905 | 686 | 475 | 360 |
| $M_2$(Mach) | 1.65 | 2.13 | 2.64 | 3.37 | 3.99 |

TABLE 2

| MOLYBDENUM PARTICLE PARAMETERS | I | II | III | IV | COMPARISON SAMPLE |
|---|---|---|---|---|---|
| STUFFING DENSITY | | | | | |
| SAMPLE A | 2.3 | 2.5 | 2.4 | 2.1 | 2.7 |
| SAMPLE B | 2.2 | 2.3 | 2.1 | 2.0 | 2.2 |
| SAMPLE C | 1.9 | 2.3 | 1.9 | 1.7 | 1.6 |
| PARTICLE DIAMETERS (angstroms) | 80–230 | 80–230 | 250–400 | 150–350 | 1.0–6 (microns) |
| AVERAGE PARTICLE DIAMETER (angstroms) | 150 | 150 | 310 | 230 | 2.5 (microns) |

TABLE 3

| COBALT PARTICLE PARAMETERS | I | II | III | IV | COMPARISON SAMPLE |
|---|---|---|---|---|---|
| STUFFING DENSITY | | | | | |
| SAMPLE A | 2.1 | 2.0 | 2.2 | 2.1 | 2.5 |
| SAMPLE B | 1.8 | 1.9 | 2.0 | 1.7 | 2.0 |
| SAMPLE C | 1.9 | 1.8 | 1.6 | 1.9 | 1.7 |
| PARTICLE DIAMETERS (angstroms) | 100–350 | 100–350 | 300–580 | 200–450 | 1.8–2.2 (microns) |
| AVERAGE PARTICLE DIAMETER | 200 | 200 | 400 | 320 | 1.9 (microns) |

TABLE 3-continued

| COBALT PARTICLE PARAMETERS | I | II | III | IV | COMPARISON SAMPLE |
|---|---|---|---|---|---|
| (angstroms) | | | | | |

What is claimed is:

1. A method of making a composite material comprising a first metallic material as a matrix material and fine particles of a second metal dispersed therein, which comprises the steps of:

rapidly cooling a vapor of said second metal by adiabatic expansion through a nozzle, thereby obtaining a jet flow of fine metal particles; and directing said jet flow of fine metal particles against the mass of said first metal in the molten state.

2. The method according to claim 1, wherein the vapor of said second metal alone is introduced into said nozzle, and wherein said jet flow from said nozzle consists substantially only of particles of said second metal.

3. The method according to claim 1, wherein the vapor of said second metal is introduced into said nozzle together with an inert gas, and wherein said jet flow from said nozzle consists substantially of particles of said second metal and said inert gas.

4. The method according to claim 1, wherein said nozzle is a convergent-divergent nozzle.

5. The method according to claim 1, wherein the molten mass of said first metallic material is stirred up by a propeller means as said jet flow impinges thereon.

* * * * *